United States Patent [19]

Phan et al.

[11] Patent Number: 4,962,689

[45] Date of Patent: Oct. 16, 1990

[54] GAS GENERATOR MISSILE LAUNCH SYSTEM

[75] Inventors: Dzung V. Phan, Moorpark; Kevin S. Minds, West Hills, both of Calif.

[73] Assignee: Hughes Aircraft Company, Los Angeles, Calif.

[21] Appl. No.: 388,262

[22] Filed: Aug. 1, 1989

[51] Int. Cl.[5] ..... F41A 1/08

[52] U.S. Cl. ..... 89/1.703; 89/1.704

[58] Field of Search ..... 89/1.7, 1.703, 1.704, 89/1.705, 1.706, 1.818, 1.51, 1.57

[56] References Cited

U.S. PATENT DOCUMENTS

| | | | |
|---|---|---|---|
| 2,949,061 | 8/1960 | Benditt et al. | 89/1.7 |
| 2,987,965 | 6/1961 | Musser | 89/1.706 |
| 3,035,494 | 5/1962 | Musser | 89/1.703 |
| 3,129,636 | 4/1964 | Strickland et al. | 89/1.703 |
| 3,215,041 | 11/1965 | Dietsch et al. | 89/1.7 |
| 3,376,764 | 4/1968 | Abramson | 89/1.703 |
| 3,380,340 | 4/1968 | Bergman et al. | 89/1.703 |
| 3,490,330 | 1/1970 | Walther | 89/1.7 |
| 3,610,093 | 10/1971 | Mebus | 89/1.7 |
| 3,653,288 | 4/1972 | Stauff et al. | 89/1.703 |

*Primary Examiner*—David H. Brown

*Attorney, Agent, or Firm*—R. M. Heald; R. A. Hays; W. Denson-Low

[57] ABSTRACT

A missile launching system with an open-ended cylindrical container (10) having a bore in which a slidable piston (20) is located between the missile (12) and a gas generator (14) adjacent the container aft end (16). The piston (20) area is substantially the same as the container bore at the aft end (16). An internal ring (42) forms a reduced area throat for gas exiting via the aft end of the container (10) with the ratio of the piston area to the throat area, $A_p/A_t$, being functionally related to the propellant physical characteristics.

6 Claims, 3 Drawing Sheets

GAS GENERATOR MISSILE LAUNCH SYSTEM

BACKGROUND OF THE INVENTION

1. Field of the Invention

The present invention relates generally to a system for launching a missile, and, more particularly to a system and method of launching a missile from a container exhibiting a substantially reduced recoil over a large range of gas operating pressures and temperatures.

2. Description of the Prior Art

It is well known to launch objects such as a missile from a container using pressurized gases generated by combustion of a suitable fuel, either liquid or solid. Recoil forces accompany such launches and, if not successfully compensated for in some manner, can be detrimental to the launch site or to individuals in the vicinity.

A variety of techniques have been resorted to in the past to compensate for these recoil forces which have involved the use of such things as counterweights, pneumatic shock absorbers, burst plates and other special apparatus or equipment which act to reduce the recoil force to an acceptable level. Although accomplishing a measure of recoil force reduction, these prior techniques have not been completely satisfactory. In the main, they require special apparatus which is either expensive to manufacture or is relatively complicated in operation so that reliability of the overall system operation is undesirably reduced.

Prior gas generated launch systems have also been accompanied by relatively high levels of noise which is undesirable in that the noise is disturbing and, in some cases, is actually detrimental to the well being of personnel in the launch site vicinity.

SUMMARY OF THE DISCLOSURE

It is a primary aim and object of the present invention to provide a method and system for launching an object such as a missile from a container by the use of pressurized gas without incurring the heretofore encountered relatively large recoil forces.

A further object of the invention is the provision of such a method and system which can operate over an extended range of operating gas pressures and temperatures with a substantially reduced amount of noise.

In the practice of the present invention, an elongated, hollow tubular container receives the missile, or other object to be propelled, into the forward end thereof. A light-weight piston is positioned within the interior of the container, against which the missile rests, and has walls which snugly and slidingly fit against the interior walls of the container. At what is the aft end of the container and beyond the piston, there is fixedly and centrally located a propellant gas generator.

Upon ignition, the gas generator pressurizes the piston driving it against the missile and in that way forces the missile out the forward end into launch. Simultaneously, gas from the generator is exited through a special nozzle in a backward direction outwardly of the container aft end establishing a counter-inertial reaction force to that of the missile in order to reduce the recoil effect. The cross-sectional area of the piston and the exit area of the nozzle are particularly formed to be the same so as to reduce the effect of ambient pressure substantially to zero. Additionally, a given ratio of the piston area to the nozzle throat area is required which is defined primarily by the specific heat ratio of the propellant to be used.

A further desideratum is to avoid propellant burning after the missile or other object leaves the container. To achieve this, it is necessary to determine piston chamber pressure at minimum temperature using minimum ambient pressure, the expected maximum tube or container length, and the missile exit velocity, the latter being equal to the minimum required velocity plus some velocity increment. The velocity increment is selected so that at maximum ambient pressure and minimum temperature, the minimum exit velocity is achieved at full stroke.

DESCRIPTION OF A PREFERRED EMBODIMENT

Figure 1:
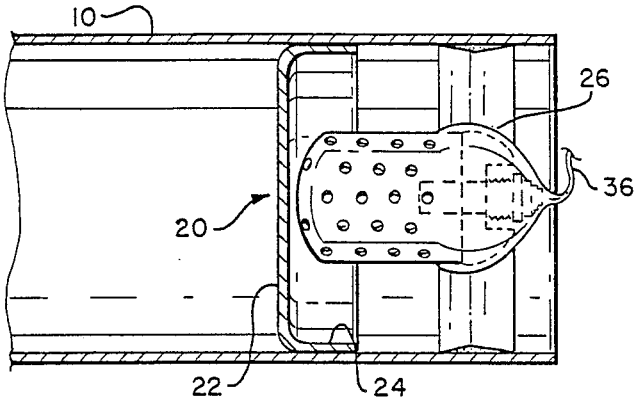
FIG. 1 is a side elevational, sectional view of a launch tube or container with the propulsion system of the invention mounted therein.
Figure 2:
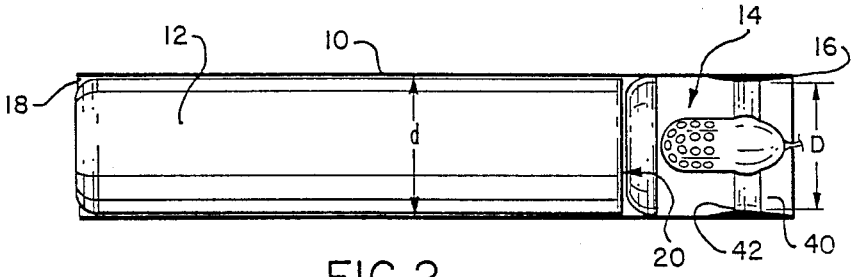
FIG. 2 depicts a launch tube or container of the launch system of the invention with a missile located therein prior to launch.
Figure 3:
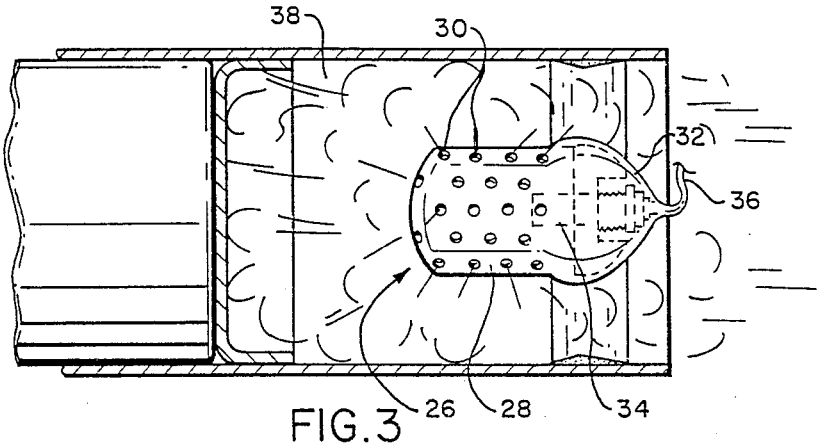
FIG. 3 shows an enlarged sectional view similar to FIG. 1 immediately after ignition.
Figure 4:
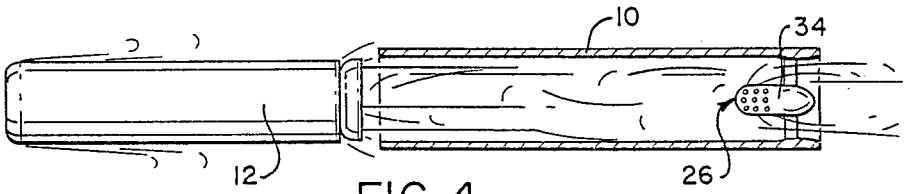
FIG. 4 is similar to FIG. 2, but shown immediately after launch, with the missile leaving the launch tube or container.

With reference now to the drawings and particularly FIGS. 1 through 4, the launch container or tube from which an object such as a missile is to be propelled in accordance with and utilization of the present invention is identified generally as 10. The container consists generally of an open ended cylindrical tube of uniform cross section and smooth interior wall surfaces, the length of which will vary according to the missile to be projected and certain other factors which will be set forth later herein. The object 12 which is to be propelled for present consideration will be considered to be a missile of generally cylindrical form having an outer diameter which enables sliding fit within the container 10.

The container launch system identified generally as 14 is located within the aft end 16 of the container opposite the forward end 18 from which the missile 12 is loaded. A movable piston 20 is a cylindrical member having an imperforate central wall 22 which extends completely across the container interior space and integrally connects with a rim or sidewall 24 that extends completely thereabout. The piston is circular in cross-section and of such outer diameter as to slidingly and sealingly engage the interior surface of the container 10. Initially the piston is located either in contact with the inner end of the missile 12 or spaced slightly therefrom.

A pressurized gas generator 26 is of conventional construction having a cylindrical hollow housing 28 with a plurality of openings 30 uniformly distributed about its surface, the housing being secured to a cap 32. The propellant charge 34 is located within the cap and is typically ignited electrically via leads 36, for example. The generator is mounted symmetrically along the longitudinal axis of the container at a point located just inwardly of the container aft end 16. The propellant typically is a solid material and as will be described in some detail, its characteristics are important in obtaining the full advantages of the invention.

Generally as to launch operation, with the missile 12 resting within the container either against the piston 20, or closely spaced thereto, the propellant is ignited and pressurized gas 38 (FIG. 3) moves the slidable piston against the missile inner end driving it out of the forward end of the container. Since the piston substantially seals against the inner wall of the container, little or none of the pressurized gases move past the piston and the forward force is exerted entirely upon moving the piston and the missile.

In addition to the gases produced by the generator which drive the piston 20, a certain portion of the gases move backwardly along the container bore and outwardly of the aft end 16 to produce a counterforce to that exerted on the missile. It is this counterforce which, in a way that will be more particularly described, substantially cancels any recoil force production in the system. A nozzle enumerated generally as 40 is formed adjacent the container aft end 16 by locating on the inner surface of the container an inwardly projecting continuous ring 42. The ring forms a nozzle throat of a diameter D which is somewhat less than the uniform inner diameter d of the container itself. The precise relationship of these two dimensions as required for advantageous operation of the invention will be described later herein. As an initial simplification for the ensuing detailed description of the invention, it can be shown that the aerodynamic forces, frictional forces, and gravitational force that result when the system is fired at relatively small launch angles, are negligible as compared to the force exerted by the pressurized gas of the generator 26. Therefore, these forces will be ignored in the following discussion and analysis. A first essential aspect for obtaining advantageous results with the described system is that the piston cross-sectional area be closely identical to the exit area of the container, i.e. measured at 16. It has been found by having these two areas the same, that the effect of ambient pressure changes are substantially removed. This result is supported by the mathematical analysis of the nozzle 40 characterized as a plug nozzle which can be analyzed by principles applied to a standard de Laval nozzle. Thrust force achieved by pressure acting against the nozzle surface can be mathematically represented as follows:

$$F_{th}=A_t C_f P_p \tag{1}$$

where, $A_t$=area of nozzle throat $P_p$=pressure in piston chamber $C_f$ (thrust coefficient) = (2)

$$C_f = \Gamma(\gamma)\left\{\frac{2\gamma}{\gamma-1}\left[1-\left(\frac{P_e}{P_p}\right)^{\frac{\gamma-1}{\gamma}}\right]\right\}^{\frac{1}{2}} + \frac{A_e}{A_t}\left(\frac{P_e}{P_p}-\frac{P_a}{P_p}\right) \tag{3}$$

with $\Gamma(\gamma) = \sqrt{\gamma}\left(\frac{2}{\gamma+1}\right)^{\frac{\gamma+1}{2(\gamma-1)}}$ C (thrust coefficient) =(2) f with (3)

and the exit to throat area ratio is related by:

$$\frac{A_e}{A_t} = \frac{\Gamma(\gamma)}{\left(\frac{P_e}{P_p}\right)^{\frac{1}{\gamma}}\left\{\frac{2\gamma}{\gamma-1}\left[1-\left(\frac{P_e}{P_p}\right)^{\frac{\gamma-1}{\gamma}}\right]\right\}^{\frac{1}{2}}} \tag{4}$$

(4)

.'L

Recoil force can be fundamentally defined as the net force between the missile forward force and the thrust force:

$$F_{rec}=F_p-F_{th} \text{ where } F_p=(P_p-P_a)A_p \tag{5}$$

where Pp=piston chamber pressures; Pa=ambient pressure; and Ap=area of piston which by substituting of the equation (1) yields, $$\frac{F_{rec}}{A_t P_p} = \frac{A_p}{A_t}\left(1-\frac{P_a}{P_p}\right) - C_f \tag{6}$$

Upon substituting the condition of the piston and exit areas being the same, the above expression eliminates the ambient pressure effect and reduces to:

$$F_{rec}=A_t P_p C_{rec} \tag{7}$$

$$\text{where } C_{rec} = \frac{A_p}{A_t}\left(1-\frac{P_e}{P_p}\right) - \Gamma(\gamma)\left\{\frac{2\gamma}{\gamma-1}\left[1-\left(\frac{P_e}{P_p}\right)^{\frac{\gamma-1}{\gamma}}\right]\right\}^{\frac{1}{2}} \tag{8}$$

where C° / where $P_e$=pressure at container exit.

Continuing the analysis for the no recoil force condition, setting Crec to zero and solving for the piston to throat area ratio results in:

$$\frac{A_p}{A_t} = \frac{\Gamma(\gamma)\left\{\frac{2\gamma}{\gamma-1}\left[1-\left(\frac{P_e}{P_p}\right)^{\frac{\gamma-1}{\gamma}}\right]\right\}^{\frac{1}{2}}}{\left(1-\frac{P_e}{P_p}\right)} \tag{9}$$

It will be noted that the piston to exit area ratio cannot be solved explicitly and by substituting (4) into (9), it is implied that, $$a\left(\frac{P_e}{P_p}\right) + b\left(\frac{P_e}{P_p}\right)^c = 1 \tag{10}$$

a i where a, b and c are coefficients defined as, $$a = \frac{1+\gamma}{1-\gamma};\ b = \frac{2\gamma}{\gamma-1};\ c = \frac{1}{\gamma} \tag{11}$$

a-1+Y.' - .1 c 1 (11)

Figure 7:
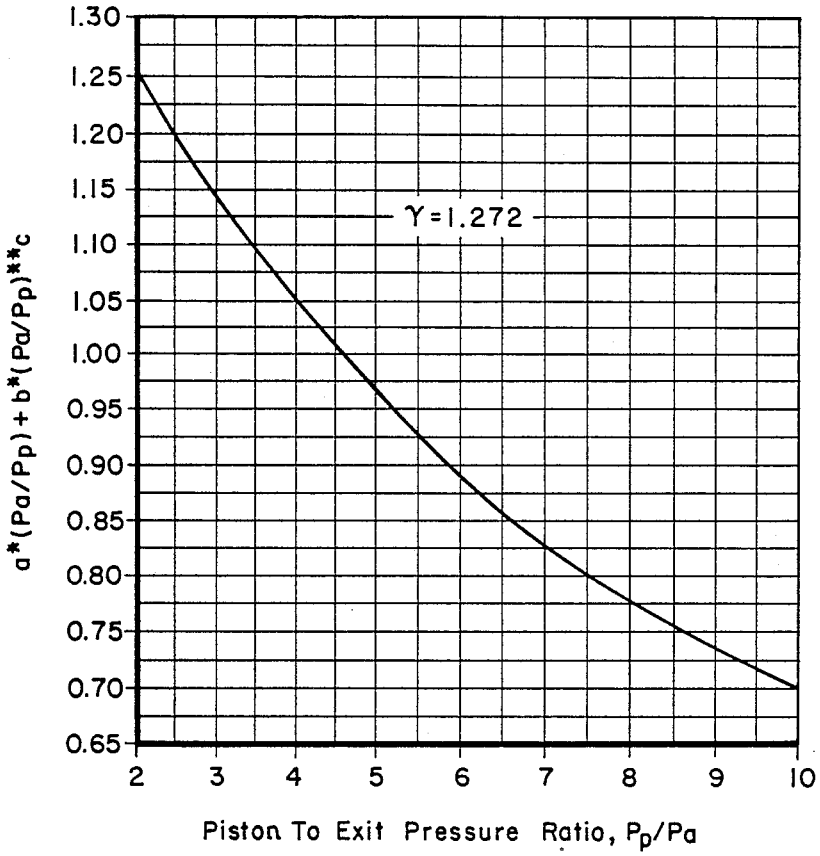

The graph in FIG. 7 shows equation (10) versus the piston to exit pressure ratio for $\gamma$=1.272 which corresponds to a propellant known as M16. Equation (10)

may now be solved for a piston to exit pressure ratio of 4.62, for example. The piston to throat area ratio is then readily solved by substituting this pressure ratio into equation (4) yielding an area ratio of 1.365.

In summary, to achieve a minimal recoil force for the full operating ambient pressure range, first of all, the area of piston 20 must be the same as the exit area of the launch tube. Then, through the relations (10) and (4), the necessary $A_p/A_t$ ratio is obtained for a particular propellant that is desired to be used. When these two criteria are met, the launch system will achieve a minimal recoil force over the full expected range of operating ambient gas pressures.

It is also important to avoid propellant burning after the missile leaves the tube, and to achieve this along with an optimal propellant design, the minimum ambient temperature should be used. This is implied from the fact that the piston chamber pressure $P_p$, experiences an exponential increase on ambient temperature increase.

More particularly, to avoid propellant burning after missile has left the tube, the piston chamber pressure, $P_p$, is determined for minimum temperature at minimum ambient pressure, maximum tube length, and missile exit velocity equal to a required minimum plus some value $\delta V$. The following basic relation for these indicated aspects can be established, $$P_p = \tfrac{1}{2}\frac{W_m}{A_p Sg}(Vm)^2 + P_a \qquad (12)$$

(12)

where,

Wm=missile weight

Vm=missile velocity

Sg=stroke

A number of design criteria will also have to be considered to make a fully practical launch system such as the propellant burning time, for example. However, by maintaining the piston and exit areas the same and providing the correct ratio of piston to throat areas for the chosen propellant achieves minimal recoil force and which also simultaneously produces less noise during launch.

Figure 5:
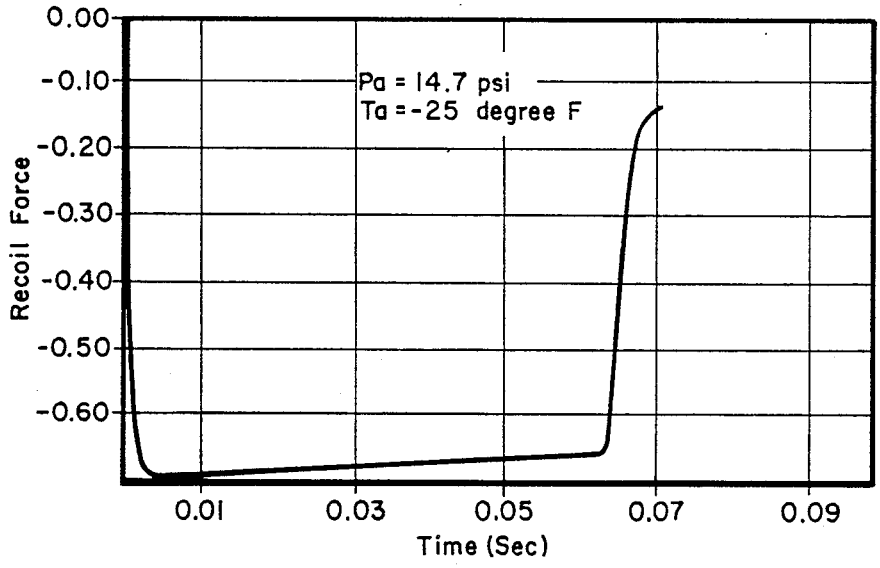
FIGS. 5, 6 and 7 are graphical depictions of various operating characteristics.
Figure 6:
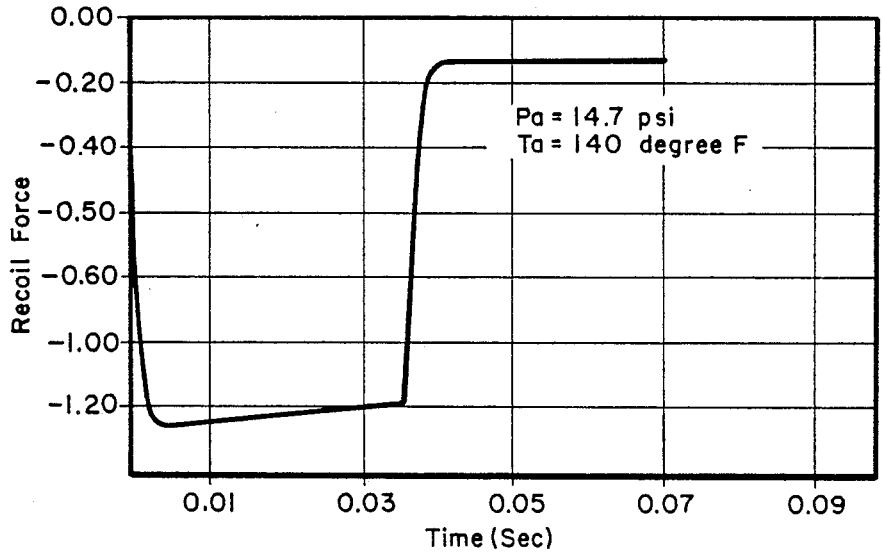

FIGS. 5 and 6 show recoil forces at two different ambient temperatures, namely, namely, −25° F. and 140° F., and at standard pressure of 14.7 pounds per square inch. As shown, the recoil forces are small as expected.

Although the invention has been described in connection with a preferred embodiment, it is to be understood that one skilled in the art could utilize modified forms therein without departing from the spirit of the invention.

What is claimed is:

1. A missile launching system with substantially zero recoil force, comprising:

a container having an inner surface forming a continuous bore with forward and aft open ends, the bore forward end portion being dimensioned for enabling receipt of a missile therewithin;

a piston slidingly received within the container bore and sealingly contracting the inner surface of the container, said piston located substantially inwardly of the container aft end;

a gas generator axially mounted within the container bore inwardly of the container aft end and spaced from the inner surface of the container, said gas generator containing a supply of a given combustible propellant; and a ring member mounted within the container bore and secured to the inner surface of the container between the gas generator and the aft end, said ring member defining a restricted circular throat of an area ($A_t$) which is less than the bore cross-sectional area ($A_e$) at the aft end;

said piston having an area ($A_p$) substantially the same as the bore cross-sectional area $A_e$ at the aft end, and the ratio $A_p/A_t$ has a value functionally related to the physical characteristics of the given propellant determined by solving $$\frac{A_p}{A_t} = \frac{\Gamma(\gamma)\left\{\frac{2\gamma}{\gamma-1}\left[1-\left(\frac{P_e}{P_p}\right)^{\frac{\gamma-1}{\gamma}}\right]\right\}^{\frac{1}{2}}}{\left(1-\frac{P_e}{P_p}\right)}$$

where $P_p$ is the pressure in bore acting upon the piston, $P_e$ is the pressure at the container bore aft end, and $\gamma$ is the specific heat ratio for the given propellant.

2. A missile launching system as in claim 1, in which $A_p/A_t$ equals about 1.365 corresponding to a $\gamma$ of about 1.272.

3. A missile launching system as in claim 1, in which the container bore is circular in cross-section and said piston includes a circular imperforate wall enclosed by a continuous rim, said rim slidingly and sealingly contacting the container bore wall.

4. A missile launching system as in claim 3, in which the gas generator is mounted between the piston and ring means.

5. A missile launching system as in claim 1, in which the missile weight (Wm), missile velocity (Vm), ambient pressure (Pa), area of piston (Ap), and stroke (Sg) are related by $$P_p = \tfrac{1}{2}\frac{W_m}{A_p Sg}(Vm)^2 + P_a$$

limiting propellant burning after missile leaves the container.

6. A missile launching system as in claim 5, in which $A_p/A_t$ equals about 1.365 corresponding to a $\gamma$ of about 1.272.

* * * * *